US012629744B2

(12) United States Patent
Albright et al.

(10) Patent No.: US 12,629,744 B2
(45) Date of Patent: May 19, 2026

(54) CAN SHELL, AND ASSOCIATED TOOLING AND METHOD

(71) Applicant: Stolle Machinery Company, LLC, Centennial, CO (US)

(72) Inventors: Steven Todd Albright, Piqua, OH (US); Dennis Cornelius Stammen, Brookville, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 0 days.

(21) Appl. No.: 18/828,294

(22) Filed: Sep. 9, 2024

(65) Prior Publication Data

US 2026/0070115 A1 Mar. 12, 2026

(51) Int. Cl.
*B21D 51/40* (2006.01)
*B21D 51/26* (2006.01)

(52) U.S. Cl.
CPC ..... *B21D 51/40* (2013.01); *B21D 51/2653* (2013.01)

(58) Field of Classification Search
CPC ..... B65D 7/36; B65D 7/34
See application file for complete search history.

(56) References Cited

U.S. PATENT DOCUMENTS 2,205,685 A * 6/1940 Conner ..... B65D 43/0233 206/508
2,412,169 A * 12/1946 O'Neil ..... B65D 51/16 53/489
5,582,319 A 12/1996 Heyes et al.
6,065,634 A 5/2000 Brifcani et al.
6,419,110 B1 7/2002 Stodd et al.
6,561,004 B1 * 5/2003 Neiner ..... B21D 51/32 413/4
6,736,283 B1 5/2004 Santamaria et al.
7,100,789 B2 * 9/2006 Nguyen ..... B21D 51/38 220/619
7,819,275 B2 10/2010 Stodd et al.
8,434,342 B2 5/2013 Stodd et al.
10,843,845 B2 11/2020 Stodd et al.
2005/0025292 A1 2/2005 Ganani et al.
2012/0012593 A1 1/2012 Kuroiwa et al.
2012/0292329 A1 11/2012 Bulso

OTHER PUBLICATIONS

U.S. Patent and Trademark Office ISA/US, PCT Application No. PCT/US2025/044797, International Search Report and Written Opinion, Oct. 30, 2025, 21 pages.

* cited by examiner

*Primary Examiner* — Stephen J Castellano
(74) *Attorney, Agent, or Firm* — Eckert Seamans Cherin & Mellott, LLC

(57) ABSTRACT

A can shell includes a center panel. An inclined panel wall extends at a downward angle from the center panel. An annular countersink is formed around the inclined panel wall and includes an inner countersink wall and an outer countersink wall. A countersink base is formed at a bottom end of the inner countersink wall and a bottom end of the outer countersink wall. A chuck wall extends from the outer countersink wall. The inner countersink wall and the outer countersink wall are generally parallel between the countersink base and the inclined panel wall and the chuck wall. A curl extends radially outwardly from the chuck wall. The countersink has a depth of between 0.265 and 0.280 inches from the uppermost surface of the curl and a depth of between 0.085 and 0.11 inches from the center panel.

13 Claims, 10 Drawing Sheets

CAN SHELL, AND ASSOCIATED TOOLING AND METHOD

FIELD OF THE INVENTION

The disclosed concept relates generally to can shells and to tooling and associated methods for providing such can shells.

BACKGROUND OF THE INVENTION

Metallic containers (e.g., cans) are structured to hold products such as, but not limited to, food and beverages. Generally, a metallic container includes a can body and a can end. The can body, in an exemplary embodiment, includes a base and a depending sidewall. The can body defines a generally enclosed space that is open at one end. The can body is filled with product and the can end is then coupled to the can body at the open end.

A "can end," as used herein, is the element coupled to a can body to form a container. The "can end" includes a tab or similar device structured to open the container. As discussed below, "can end" is, typically, formed from a "shell." That is, a shell is formed from a generally planar blank cut from sheet material. The blank is formed to include an annular countersink, a chuck wall, and other constructs.

A container is exposed to pressures during processing. For example, some food items are cooked and/or sterilized while in the container. Such a container is exposed to both internal pressure, also identified herein as "buckle" or "buckle pressure," as well as external pressure, also identified herein as "reverse buckle" or "reverse buckle pressure." A container, that is the can body and the can end, must have the strength to resist deformation due to buckle pressure and/or reverse buckle pressure.

Generally, the strength of the container is related to the thickness of the metal from which the can body and the can end is formed, as well as, the shape of these elements. This application primarily addresses the can ends rather than the can bodies. The can ends are either a "sanitary" can end or an "easy open" end. As used herein, a "sanitary" end is a can end that does not have a tab or score profile to open and would have to be opened by use of a can opener or other device. As used herein, an "easy open" can end includes a tear panel and a tab. The tear panel is defined by a score profile, or scoreline, on the exterior surface (identified herein as the "public side") of the can end. The tab is attached (e.g., without limitation, riveted) adjacent the tear panel. The pull tab is structured to be lifted and/or pulled to sever the scoreline and deflect and/or remove the severable panel, thereby creating an opening for dispensing the contents of the container. The following addresses an "easy open" can end but is also applicable to a "sanitary" can end. That is, a "sanitary" can end is produced in a similar manner, and coupled to a can body in a similar manner. Thus, as used herein, a can end is further defined as including constructs that are used for both "sanitary" can ends and "easy open" ends.

When the can end is made, it originates as a blank, which is cut from a sheet metal product (e.g., without limitation, sheet aluminum; sheet steel). In an exemplary embodiment, the blank is then formed into a "shell" in a shell press. As used herein, a "shell" is a construct that started as a generally planar blank and which has been subjected to forming operations other than rivet forming and tab staking. The shell press includes a number of tool stations where each station performs a forming operation (or which may include a null station that does not perform a forming operation). The blank moves through successive stations and is formed into the "shell." A shell is, in an exemplary embodiment, a "sanitary" can end that is structured to be coupled to a can body.

For an "easy open" end, a shell is further conveyed to a conversion press, which also has a number of successive tool stations. As the shell advances from one tool station to the next, conversion operations such as, for example and without limitation, rivet forming, paneling, scoring, embossing, and tab staking, are performed until the shell is fully converted into the desired can end and is discharged from the press. Thus, as used herein, a "can end" includes a "shell" as well as a construct including a tab and a score line.

In the can making industry, large volumes of metal are required in order to manufacture a considerable number of cans. An ongoing objective in the industry is to reduce the amount of metal that is consumed. Efforts are constantly being made, therefore, to reduce the thickness or gauge (sometimes referred to as "down-gauging") of the stock material from which can ends, tabs, and can bodies are made. However, as less material (e.g., thinner gauge) is used, problems arise that require the development of unique solutions. When the base gauge of the metal is too thin, the can end may have insufficient buckle resistance and can deform.

It is also desirable in the can making industry to increase the use of recyclable materials and transition to alloys that are more efficiently recycled. Presently, can ends are made from sheet metal such as, but not limited to, aluminum and steel as well as alloys including those metals. Many alloys which are more efficiently recycled have different characteristics than materials more commonly used in the industry. For example, recycling-efficient alloys may be characterized by a higher hardness, a lower formability, a lower cost, and/or a poorer quality.

The use of alloys with a higher hardness, lower formability, less expense, and/or a poorer quality, however, has been found to generate other problems such as, but not limited to, increased tearing, uneven coining, and excess loose metal. These difficulties arise with alloys of these properties because they are resistant to localized forming, which can be prone to cracks or breaking during forming or failing to meet existing performance requirements. Previous tooling relied on this localized forming, and in turn resulted in too much stress (resulting in cracks/breaks) or would draw metal from unintended areas, thereby affecting performance requirements.

Using less metal and/or using alloys with better recyclability promotes a more sustainable can making operation and may reduce the industry's carbon footprint. Using less aluminum reduces the amount of consumable resources that are utilized in manufacturing and transporting large volumes of aluminum for can making. Furthermore, using less aluminum reduces the consumption of consumable resources during the can making process, such as electricity, gas, and water.

There is, therefore, a need for improvement in can ends and shells. It is particularly beneficial to provide an improvement that is applicable for use with all types of alloys currently and anticipatorily used in can making.

SUMMARY OF THE INVENTION

These needs, and others, are met by the various embodiments of the presently disclosed technology.

In one exemplary embodiment of the presently disclosed technology, a can end includes a center panel. An inclined panel wall extends at a downward angle from the center panel. An annular countersink is formed around the inclined panel wall. The annular countersink includes an inner countersink wall and an outer countersink wall. A countersink base is formed at a bottom end of the inner countersink wall and a bottom end of the outer countersink wall. The inner countersink wall and the outer countersink wall are generally parallel between the countersink base and the inclined panel wall and the chuck wall. A chuck wall extends upward from the outer countersink wall. A curl extends radially outward from the chuck wall.

In another exemplary embodiment of the presently disclosed technology, a tooling assembly for forming a countersink in a can end includes an upper tool assembly and a lower tool assembly. The upper tool assembly and the lower tool assembly are structured to cooperate and to form a can shell, the can shell including a center panel, an inclined panel wall extending at a downward angle from the center panel, an annular countersink formed around the inclined panel wall, a countersink base is formed at a bottom end of the inner countersink wall and a bottom end of the outer countersink wall, wherein the inner countersink wall and the outer countersink wall are generally parallel between the countersink base and the inclined panel wall and the chuck wall, the annular countersink including an inner countersink wall and an outer countersink wall, a chuck wall extending from the outer countersink wall, and a curl extending radially outwardly from the chuck wall.

In another exemplary embodiment of the presently disclosed technology, a method of forming a countersink in a can end includes providing a blank. A tooling with an upper tool assembly and a lower tool assembly is provided. The blank is introduced between the upper tool assembly and the lower tool assembly. The blank is formed to include a center panel, an inclined panel wall extending at a downward angle from the center panel, an annular countersink formed around the inclined panel wall, a countersink base is formed at a bottom end of the inner countersink wall and a bottom end of the outer countersink wall, wherein the inner countersink wall and the outer countersink wall are generally parallel between the countersink base and the inclined panel wall and the chuck wall, the annular countersink including an inner countersink wall and an outer countersink wall, a chuck wall extending from the outer countersink wall, and a curl extending radially outwardly from the chuck wall.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
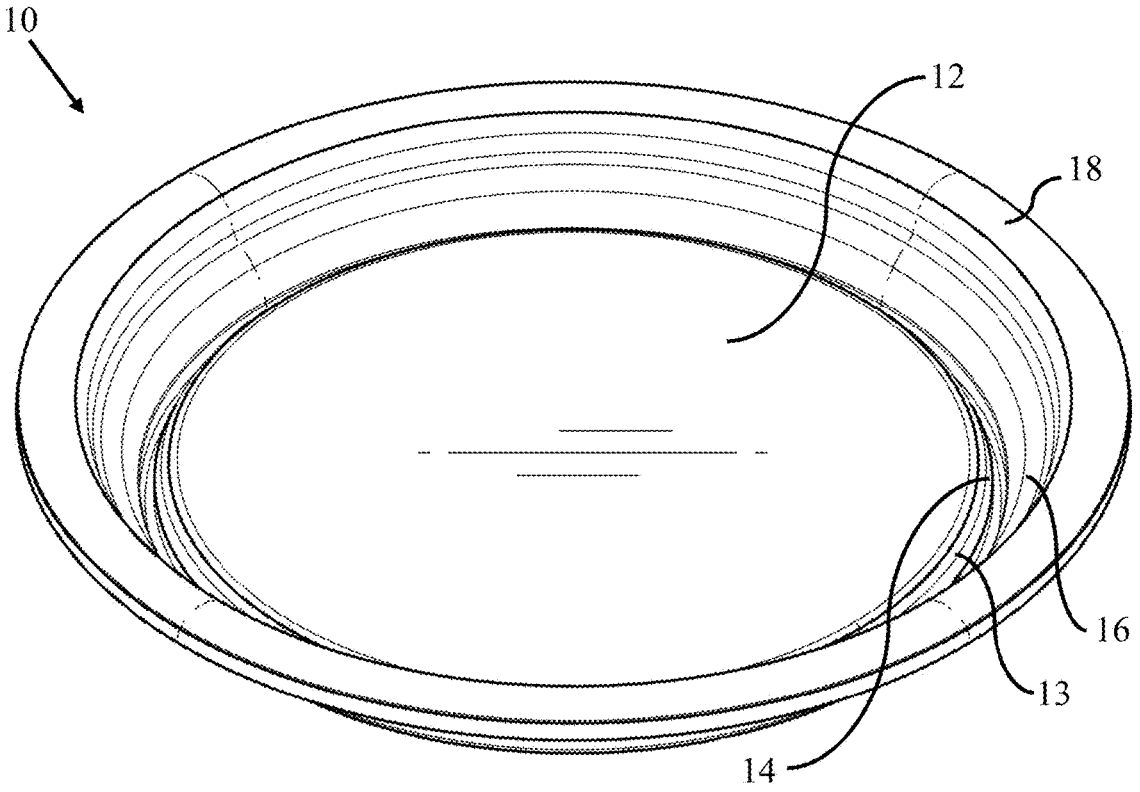
FIG. 1 is a top isometric view of a can shell in accordance with an example embodiment of the disclosed concept.
Figure 2:
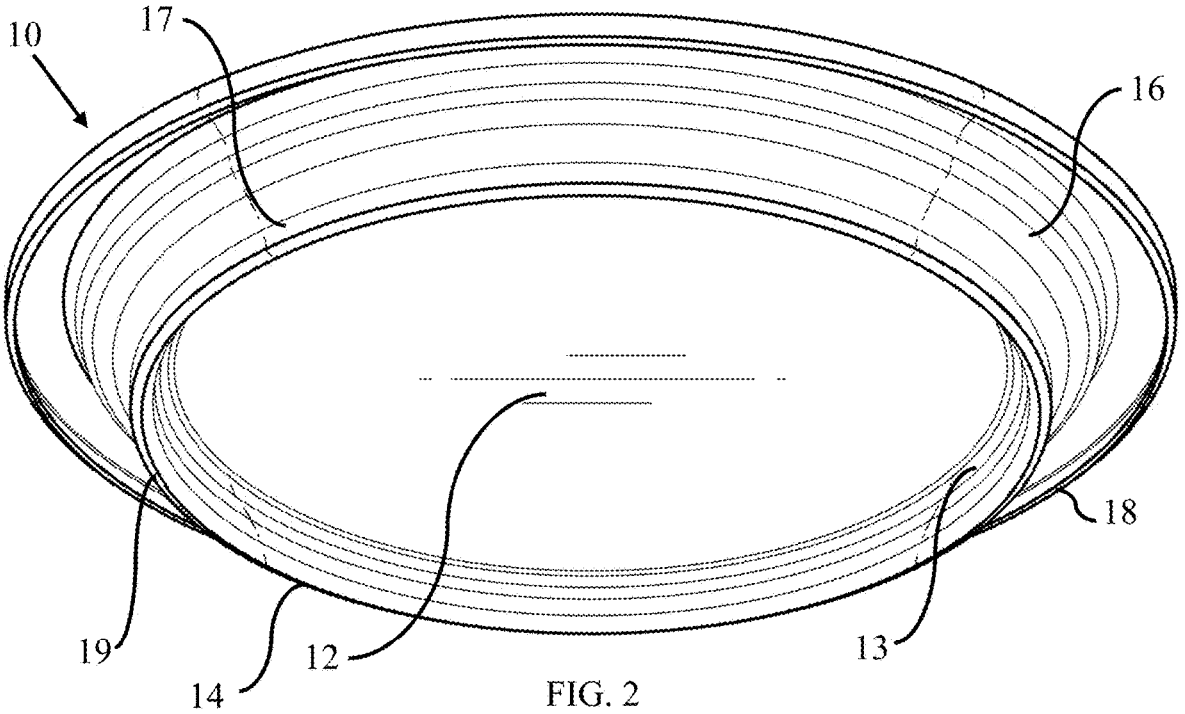
FIG. 2 is a bottom isometric view of the can shell of FIG. 1.
Figure 3:
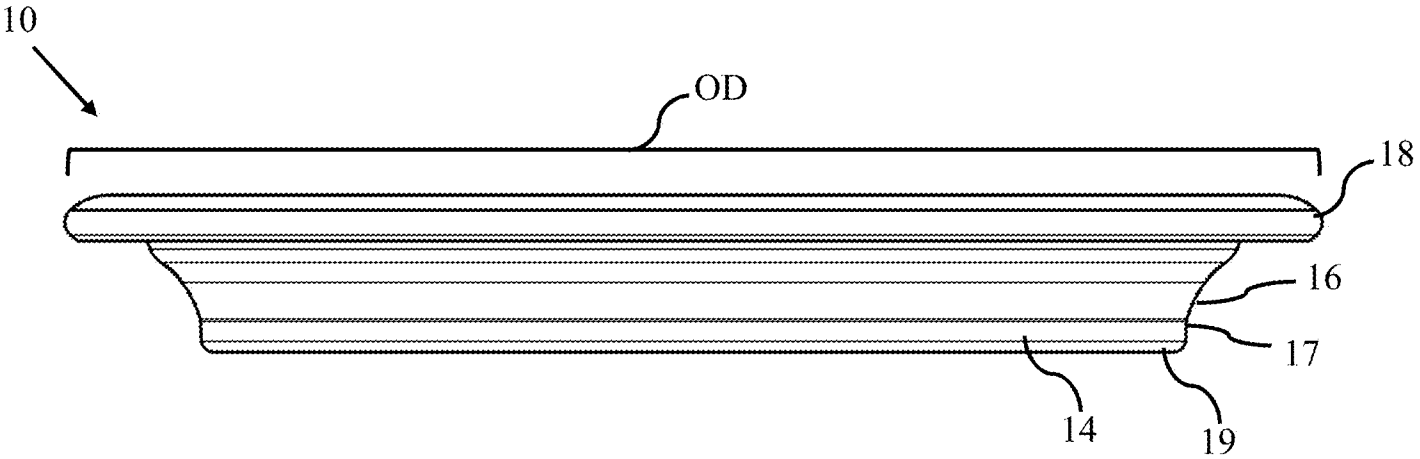
FIG. 3 is a side view of the can shell of FIG. 1.
Figure 4:
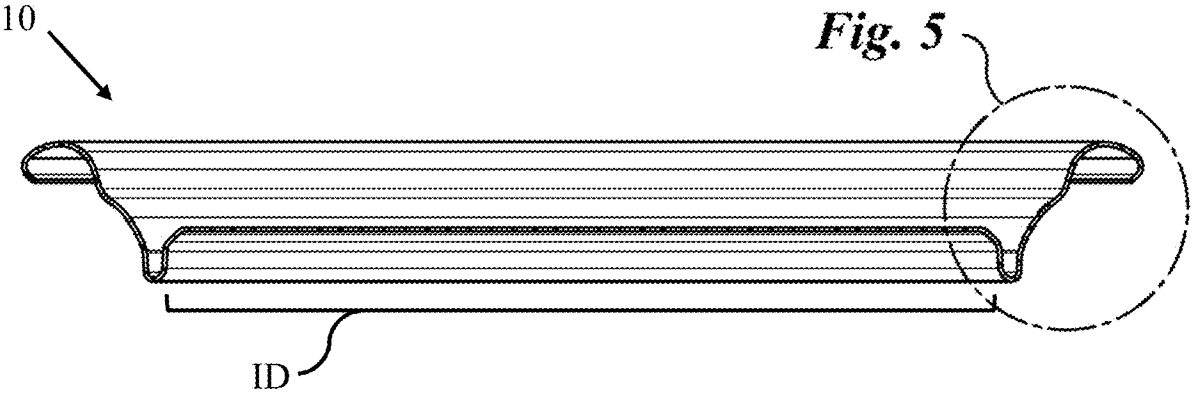
FIG. 4 is a cross-sectional side view of the can shell of FIG. 1 taken from line 4-4 in FIG. 6.
Figure 5:
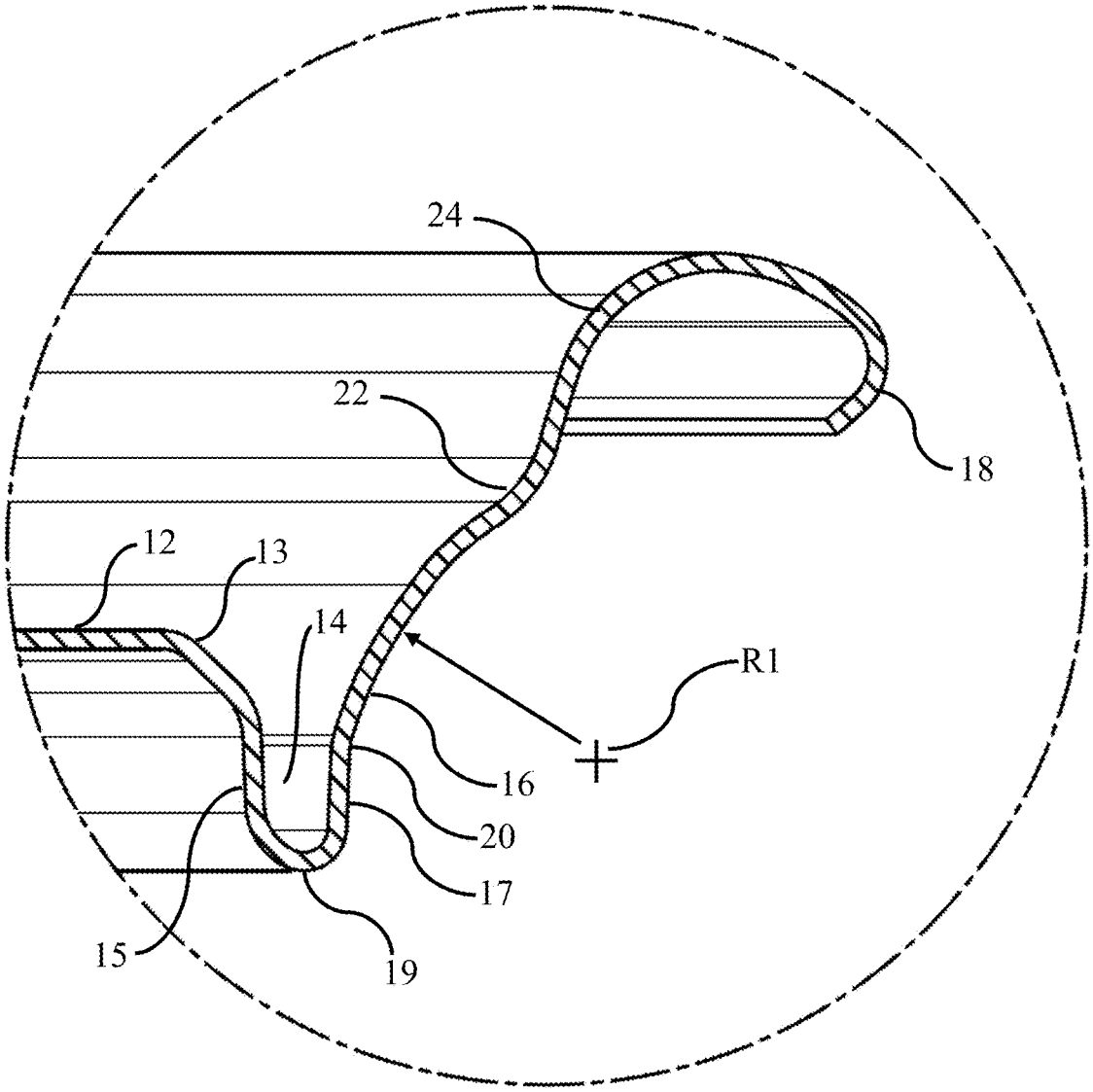
FIG. 5 is an enlarged detail view of the can shell of FIG. 1 taken from the callout of FIG. 4.
Figure 6:
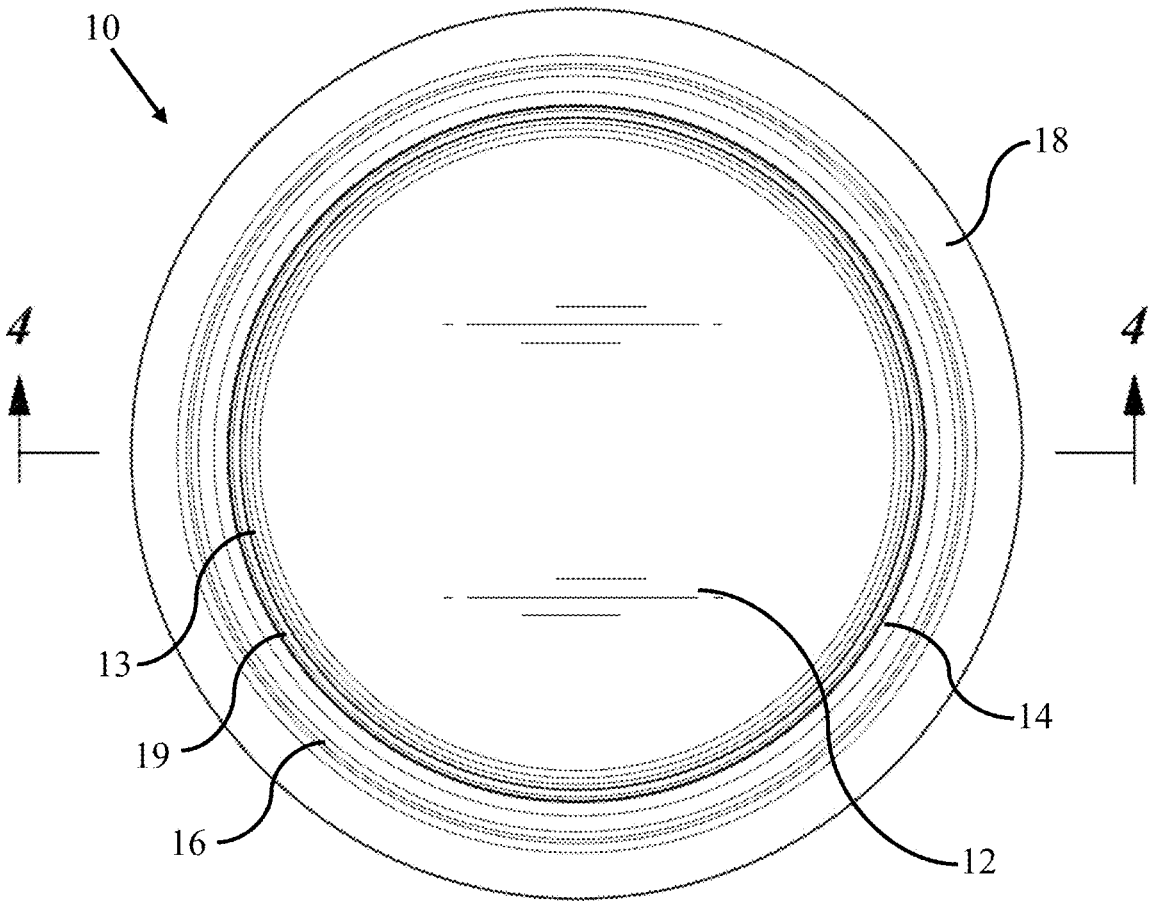
FIG. 6 is a top plan view of the can shell of FIG. 1.
Figure 7:
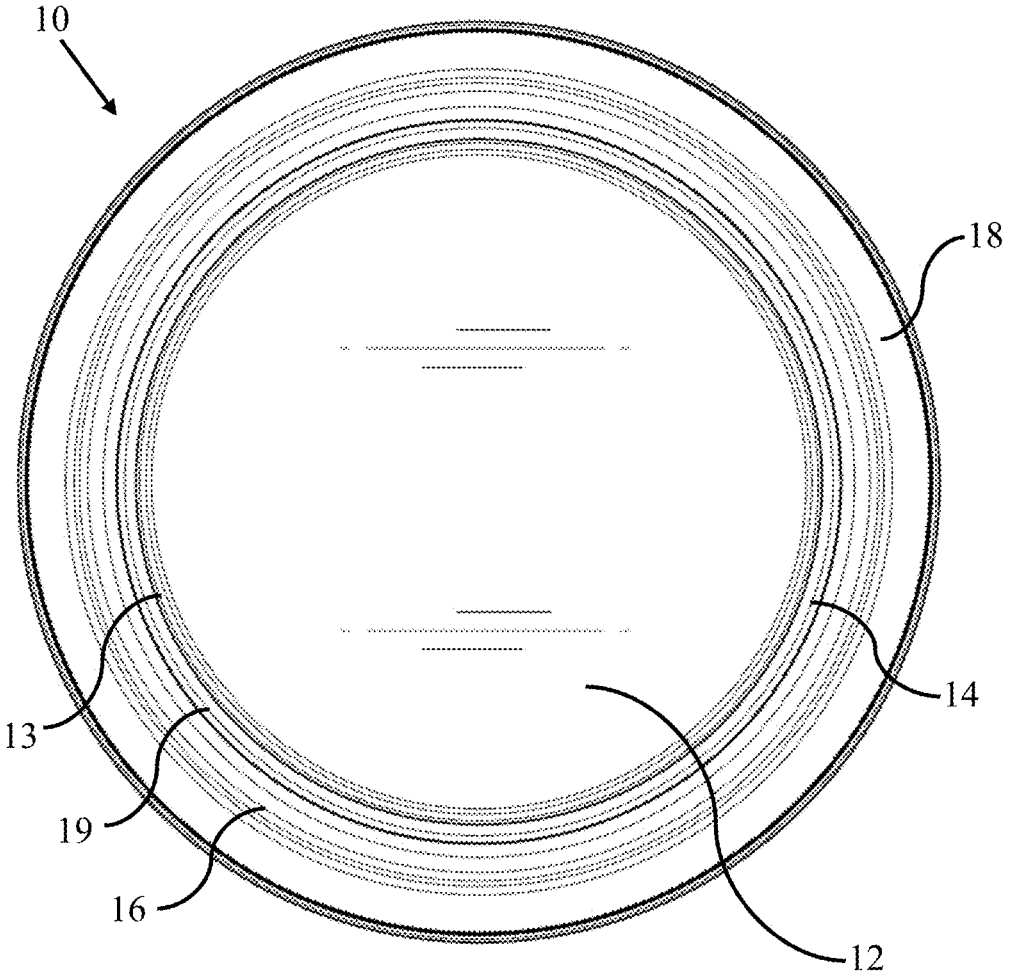
FIG. 7 is a bottom plan view of the can shell of FIG. 1.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, the term "number" shall mean one or an integer greater than one (i.e., a plurality).

Figure 8A:
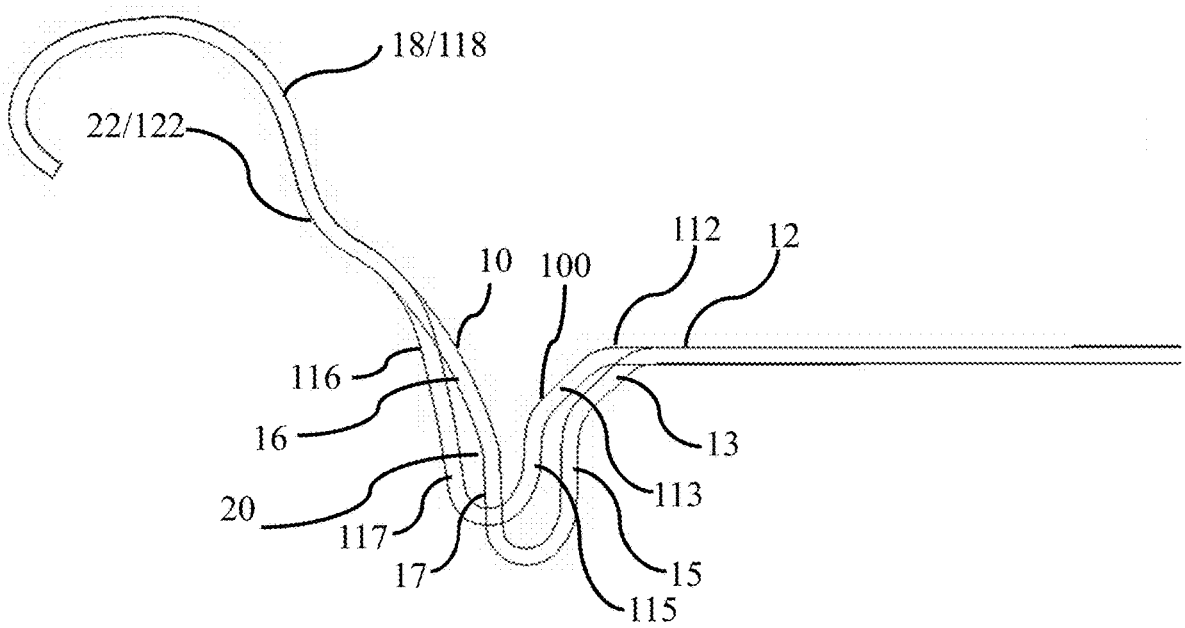
FIG. 8A is an overlay comparison of a cross-sectional side view of the can shell of FIG. 1 taken from line 4-4 in FIG. 6 with an existing can shell.
Figure 8B:
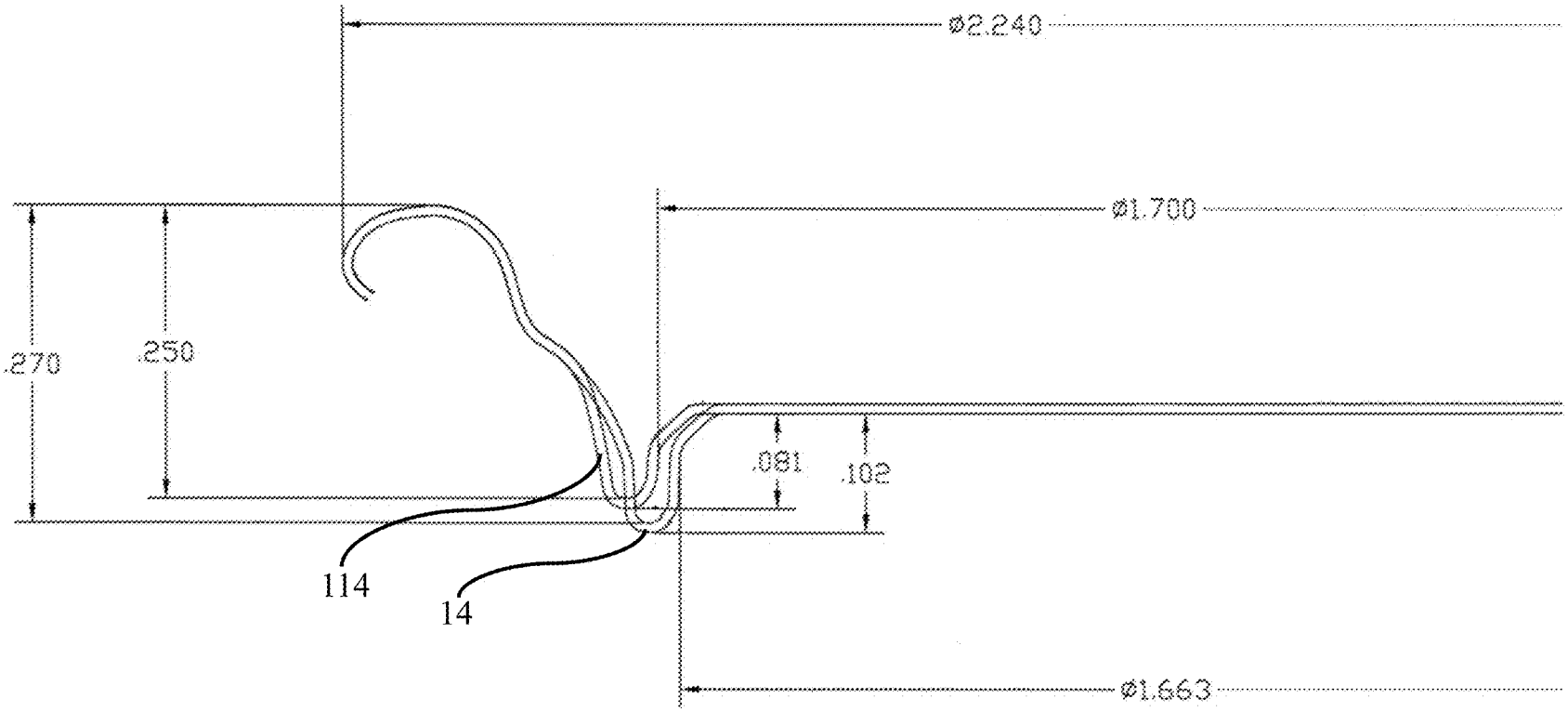
FIG. 8B is an overlay comparison of a cross-sectional side view of the can shell of FIG. 1 taken from line 4-4 in FIG. 6 with an existing can shell.
Figure 8C:
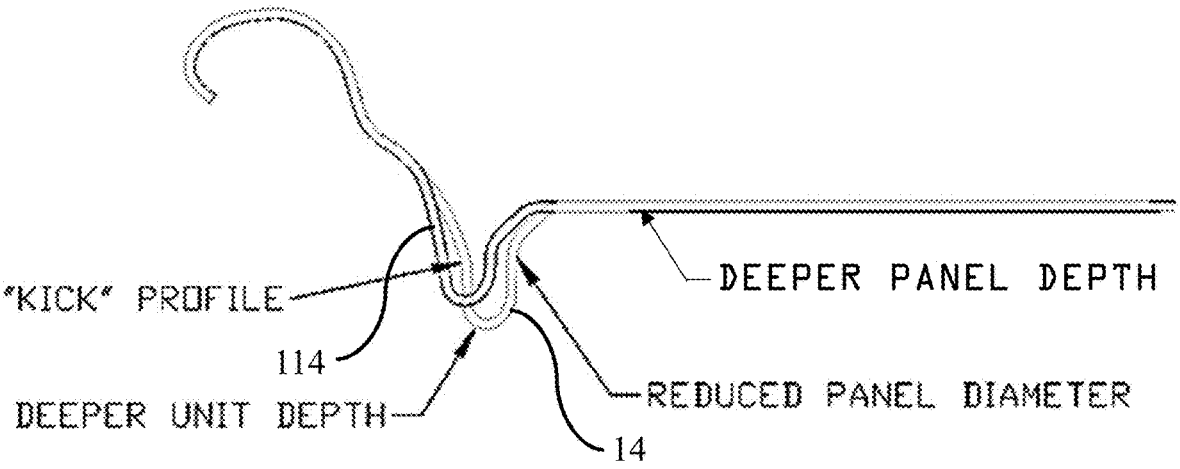
FIG. 8C is an overlay comparison of a cross-sectional side view of the can shell of FIG. 1 taken from line 4-4 in FIG. 6 with an existing can shell.

FIGS. 1-7 are various views of a can shell 10 in accordance with an example embodiment of the disclosed concept. FIGS. 8A-8C are various overlay views of the can shell 10 in accordance with an example embodiment of the disclosed concept with respect to an existing can shell 100. Similar or identical structure as between the presently disclosed technology of FIGS. 1-7 and existing technology shown by comparison in FIGS. 8A-8C is distinguished in FIGS. 8A-8C by a reference number with a magnitude one hundred (100) greater than that of FIGS. 1-7. Description of certain similarities between the presently disclosed technology and the existing technology may be omitted herein for convenience and brevity only, but is not limiting.

The can shell 10 of the presently disclosed technology can include a center panel 12, an inclined panel wall 13, an annular countersink 14, a chuck wall 16, and a curl 18. The center panel 12 extends radially outward from the center of the can shell 10. The inclined panel wall 13 extends from the outer end of the center panel 12 at a downward angle to the annular countersink 14. The annular countersink 14 includes an inner countersink wall 15 spaced-apart from an outer countersink wall 17. A countersink base 19 is formed at a bottom end of the inner countersink wall 15 and a bottom end of the outer countersink wall 17. The chuck wall 16 extends upward from the outer countersink wall 17 to the curl 18. In an exemplary embodiment, the chuck wall 16 has a greater length than the inclined panel wall 13. As such, the center panel 12 is at a relatively lower height than the curl 18.

The can shell 10 may be formed from a substantially planar blank. The can shell 10 may be converted into a can end in a subsequent conversion process, which may include forming a rivet in the can shell 10, scoring a tab opening in the can shell 10, and staking a tab to the can shell 10.

In an exemplary embodiment of the disclosed concept, the inner countersink wall 15 and the outer countersink wall 17 are generally parallel from the countersink base 19 to the inclined panel wall 13 and the chuck wall 16, respectively. As used herein, the term "generally parallel" means within 5 degrees or less of parallel alignment. In a further embodiment, the inner countersink wall 15 and the outer countersink wall 17 are disposed at an approximately 90 degree angle relative to the countersink base 19. In the illustrated embodiment, the countersink base 19 is asymmetrical. That is the radius of curvature between the outer countersink wall 17 and the countersink base 19 is greater than the radius of curvature between the inner countersink wall 15 and the countersink base 19.

The exactly or generally parallel orientation of the inner countersink wall 15 and the outer countersink wall 17 provides a stronger product than currently available because it may withstand increased resistance to buckle pressure and/or higher pressure resistance. These benefits exist even while maintaining compatibility with existing shell formations. By creating a shell profile that is stronger in resistance, there are also opportunities to reduce the thickness of the material for cost savings and/or recyclability, while maintaining a similar bubble resistance and/or strength.

In another exemplary embodiment of the disclosed concept, the inclined panel wall 13 extends downward and outward from the center panel 12 at approximately a 45 degree angle. As such, the inclined panel wall 13 defines a distance of the can shell 10 between the center panel 12 and annular countersink 14. This distance relieves pressure that could be applied to an otherwise curvature resulting from forming the annular countersink 14 directly next to the center panel 12. The inclined panel wall 13 of the exemplary embodiment also enables the formation of a relatively narrower annular countersink 14 and relatively smaller center panel 12, which may provide desirable pressure resistance.

The can shell 10 in accordance with an example embodiment of the disclosed concept includes a kick portion 20 in the chuck wall 16. The kick portion 20 has a curved shape which has a radius R1 with respect to a point on an exterior of the can shell 10. That is, the kick portion 20 has at least a slightly concave shape with respect to an exterior of the can shell 10 and/or the chuck wall 16 extends at a different angle than the outer countersink wall. In some example embodiments, the kick portion 20 may extend from the outer countersink wall 17 to an inner wall 24 of the curl 18. In some example embodiments, the kick portion 20 may include the entire chuck wall 16. In some example embodiments, the kick portion 20 may include a portion of the chuck wall 16. For example, the kick portion 20 may extend from the outer countersink wall 17 to an upper chuck wall portion 22. The upper chuck wall portion 22 may extend from the kick portion 20 to the inner wall 24 of the curl 18. Similarly, in some example embodiments, a lower chuck wall portion may be disposed between the outer countersink wall 17 and the kick portion 20. In some example embodiments, the kick portion 20 begins in a plane below the lowest point of the inclined panel wall 13. That is, the curved shape of the kick portion 20 of the chuck wall 16 begins at a lower point of the chuck wall 16 below the lowest point of the inclined panel wall 13.

As shown in FIGS. 8A-8C, the existing can shell 100 includes a center panel 112, an inclined panel wall 113, an annular countersink 114, and a curl 118 similar to the can shell 10 in accordance with an example embodiment of the disclosed concept. However, the chuck wall 116 in the existing can shell 100 does not include the kick portion 20 of the can shell 10. Rather, the chuck wall 116 extends linearly from an outer countersink wall 117 to an upper chuck wall portion 122. That is, the chuck wall 116 of the existing can shell 100 has a linear shape that extends directly in a linear path from the outer countersink wall 117 to a point above the lowest point of the inclined panel wall 113. The upper chuck walls 22, 122 and the curls 18, 118 are identical in the can shell 10 of the present disclosure and the existing can shell 100, such that the can shell 10 of the present disclosure may be installed upon existing, standard-sized can bodies known in the art.

As noted above, the can shell 10 in accordance with example embodiments of the disclosed concept provides increased resistance to buckle pressure over the existing can shell 100 by, for example, providing the kick portion 20 in the chuck wall 16. It will be appreciated that in some example embodiments of the disclosed concept, the kick portion 20 begins at a point lower than the lowest point of the inclined panel wall 13. The can shell 10 may use a lower gauge blank than the existing can shell 100, thus reducing metal usage. Specifically, by providing a can shell 10 with a deeper annular countersink 14 than that of the existing can shell 110, it was unexpectedly discovered that a blank with a lower gauge can be utilized, which ultimately uses approximately 10% less metal than the existing can shell 110 while having a negligible effect on buckle pressure. In other words, although a deeper geometry like that of the can shell 10 of the presently disclosed technology would be expected to require more material, the deeper geometry allows for less material or metal to be used. This is beneficial for numerous reasons, including reduce costs and less impact on the environment.

In one embodiment, the can shell 10 can be made from a metal with a gauge or thickness less than 0.0082 inches. For example, the can shell 10 may be made from a metal with a gauge or thickness of 0.0076 inches.

FIGS. 8A-8C are overlay comparisons of the can shell 10 and the existing can shell 100. In the exemplary embodiment of the presently disclosed technology, the annular countersink 14 may a greater depth and/or may be positioned at least slightly inwardly toward a center of the can shell 10 relative to annular countersinks generally known and used in the prior art (represented by annular countersink 114).

For example, in an exemplary embodiment of the presently disclosed technology, the inner countersink wall 15 and the outer countersink wall 17 define between 30% and 70% of the depth of the annular countersink 14. In another exemplary embodiment, the inner countersink wall 15 and the outer countersink wall 17 define approximately 50% of the depth of the annular countersink 14.

In one exemplary embodiment of the presently disclosed technology, as shown in FIG. 8B, the annular countersink 14 has a depth of 0.102 inches relative to the center panel 12 of the can shell 10. Furthermore, in the exemplary embodiment, the annular countersink 14 has a depth of 0.270 relative to an uppermost surface of the curl 18. The presently disclosed technology is not limited to such exact depths, as the depth of the button surface of the annular countersink 14 could range from 0.085 inches to 0.11 inches from the bottom surface of the center panel 12 and 0.265 to 0.280 inches from an uppermost point of the curl 18 to the lowest interior surface of the annular countersink 14. In contrast, the representative prior art annular countersink 114 has a depth of 0.080 to 0.083 inches from the bottom surface of the annular countersink 114 to the bottom surface of the center panel 112 and 0.250 inches from an uppermost point of the curl 118 to the lowest interior surface of the annular countersink 114. By providing an annular countersink 14 with a greater depth than the prior art, the annular countersink 14 increases the overall strength of the can shell 10 by increasing the resistance to buckle pressure around the perimeter of the can shell 10.

In the exemplary embodiment, the can shell 10 has an outer diameter OD between 2.200 and 2.280 inches. The outer diameter is defined from opposing sides of an outermost edge of the curl 18. In the specific embodiment, the can shell 10 has an outer diameter of 2.240 inches. The outer diameter of the disclosed technology is configured to be formed into a "200 can end." That is, when the can shell 10, 100 is secured onto a can body, the diameter of the can shell 10, 100 is approximately 2 inches. A 200 can end corresponds to a "slim" style can as known and used in the prior art.

Additionally or alternatively, in the exemplary embodiment of the presently disclosed technology, the center panel 12 has a relatively smaller diameter relative to center panels generally known and used in the prior art (represented by center panel 112). For example, in one exemplary embodiment, the center panel 12 has an inner diameter ID of 1.663 inches or 1.663 inches or less between opposing sides of the inner countersink wall 15. In another embodiment, the presently disclosed technology is not limited to such an exact diameter, as the inner diameter of the center panel 12 could range from 1.643 inches to 1.683 inches between opposing sides of the inner countersink wall 15. In contrast, the representative prior art center panel 112 has an inner diameter of 1.700 inches between opposing sides of the inner countersink wall 115. The center panel 12 having a reduced inner diameter provides additional strength to the can shell 10 and/or reduces the force applied to the center panel 12 (e.g., reduces the pounds of force per area on the panel area).

Figure 9:
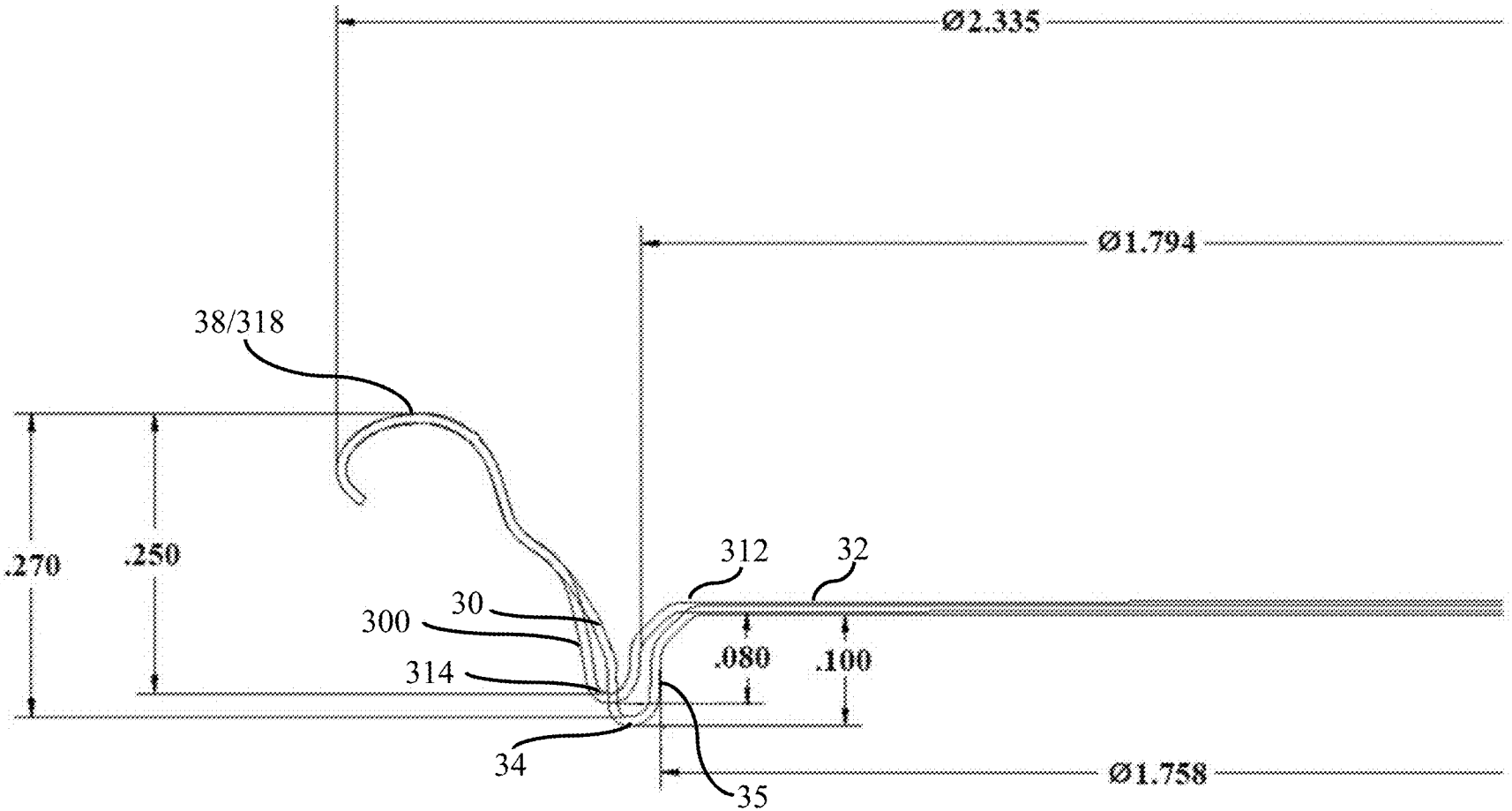
FIG. 9 is an overlay comparison of a cross-sectional side view of a can shell according to an embodiment of the presently disclosed technology with an existing can shell.

FIG. 9 shows an overlay comparison of a can shell 30 of the presently disclosed technology with an existing can shell 300. In the exemplary embodiment, the can shell 30 has an outer diameter OD between 2.295 and 2.375 inches. The outer diameter is defined from opposing sides of the outermost edge of the curl 38. In the specific embodiment, the can shell 10 has an outer diameter of 2.335 inches. The can shell 30 and the existing can shell 300 are dimensioned for use as a "202 can end." That is, when installed upon a can body, the diameter of the can ends 30, 300 is approximated 2 and 2/16 inches. A 202 can end corresponds to a "standard" style can as known and used in the prior art.

In the exemplary embodiment of FIG. 9, the annular countersink 34 has a depth of 0.100 inches relative to the center panel 32 of the can shell 30. Furthermore, in the exemplary embodiment of FIG. 9, the annular countersink 34 has a depth of 0.270 inches relative to the uppermost surface of the curl 38. The presently disclosed technology is not limited to such exact depths, as the depth of the annular countersink 34 could range from 0.085 inches to 0.11 inches from the bottom surface of the center panel 32 to the bottom surface of the annular countersink 34 and from 0.265 to 0.280 inches from the uppermost surface of the curl 38 to the lowest interior surface of the countersink. In contrast, the representative prior art annular countersink 314 has a depth of 0.080 to 0.083 inches from the bottom surface of the annular countersink 314 to the bottom surface of the center panel 312. By providing an annular countersink 34 with a deeper depth, the annular countersink 34 increases the overall strength of the can shell 30 by increasing the resistance to buckle pressure around the perimeter of the can shell 30.

Additionally or alternatively, in the exemplary embodiment of the presently disclosed technology, the center panel 32 has a relatively smaller diameter relative to center panels generally known and used in the prior art (represented by center panel 312). For example, in one exemplary embodiment, the center panel 32 has an inner diameter ID of 1.758 inches or 1.758 inches or less between opposing sides of the inner countersink wall 35. In another embodiment, the presently disclosed technology is not limited to such an exact diameter, as the inner diameter of the center panel 32 could range from 1.738 inches to 1.778 inches between opposing sides of the inner countersink wall 35. The center panel 32 having a reduced inner diameter provides additional strength to the can shell 30 and/or reduces the force applied to the center panel 32 (e.g., reduces the pounds of force per area on the panel area).

Figure 10:
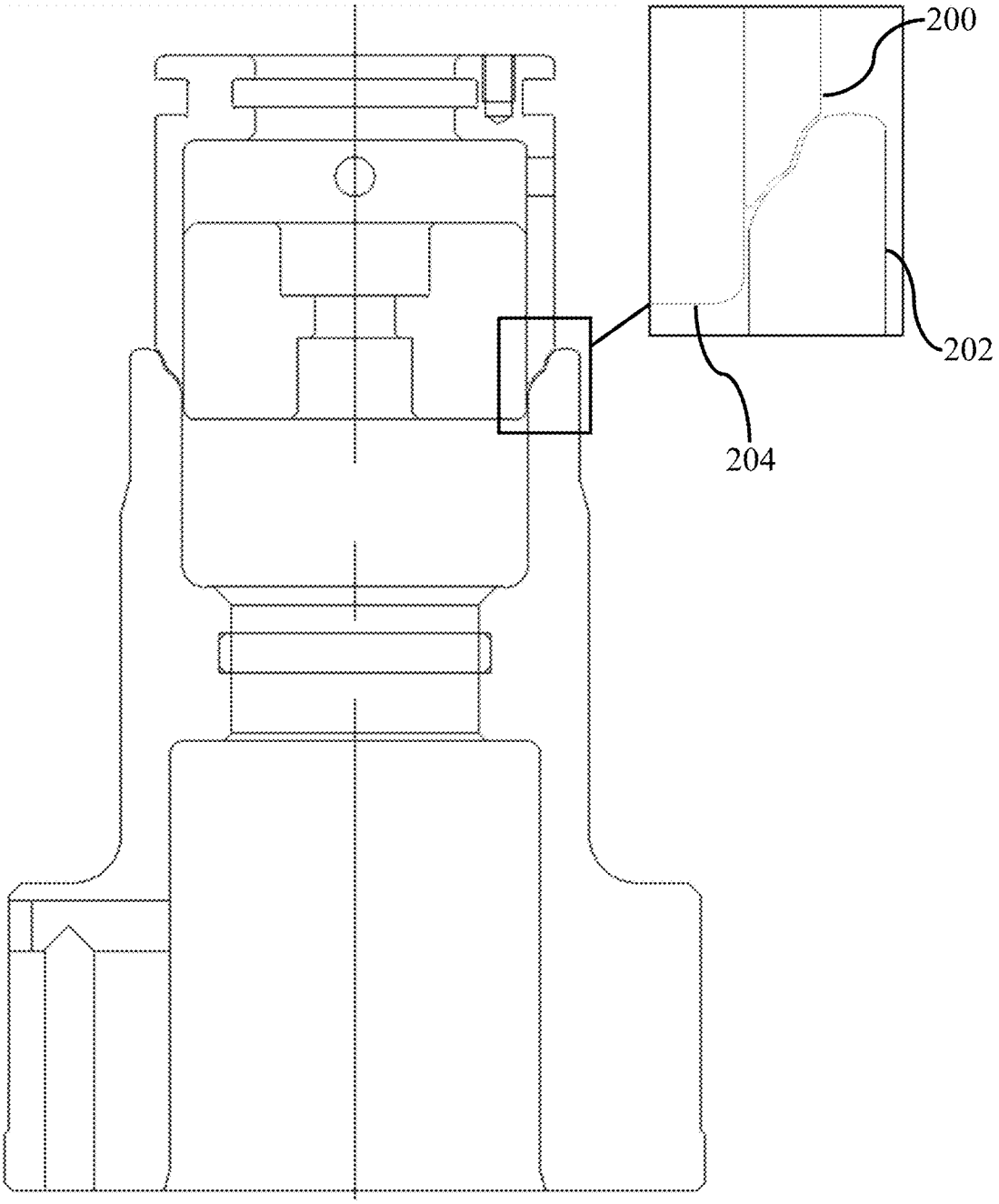
FIG. 10 is a cross-sectional view of tooling for forming the can shell of FIG. 1.

FIG. 10 is a cross-sectional view of tooling for forming the can shell 10. The tooling for forming the can shell 10 includes upper tooling and lower tooling. The upper tooling includes an inner pressure sleeve 200 and die center 204, and the lower tooling includes a die core ring 202. A blank is disposed between the upper tooling and the lower tooling, and the upper tooling is pressed onto the lower tooling to form the can shell 10. In the process of pressing the upper tooling onto the lower tooling, the inner pressure sleeve 200 is pressed onto the die core ring 202 to form the chuck wall 16 including the kick portion 20 of the can shell. The shape of the inner pressure sleeve and die core ring corresponds to the shape of the chuck wall 16 including the kick portion 20 so as to form the chuck wall 16 including the kick portion 20.

It will be appreciated that the disclosed concept also covers methods of forming the can shell 10. The disclosed concept covers methods of forming the can shell 10 from a blank. It will also be appreciated that the disclosed concept also covers forming the can shell 10 in the shell forming process, as well as forming the can shell 10 in the conversion process, such as in a conversion press.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of disclosed concept which is to be given the full breadth of the claims appended and any and all equivalents thereof.

What is claimed is:

1. A can shell comprising:

a center panel;

an inclined panel wall extending at a downward angle from the center panel;

an annular countersink formed around the inclined panel wall, the annular countersink including an inner countersink wall and an outer countersink wall;

a countersink base formed at and connecting a bottom end of the inner countersink wall and a bottom end of the outer countersink wall, wherein a first radius of curvature between the outer countersink wall and the countersink base is different than a second radius of curvature between the inner countersink wall and the countersink base, thereby causing the countersink base to be asymmetrical;

a chuck wall extending from the outer countersink wall, at least a portion of the chuck wall having a concave shape; and a curl extending radially outwardly from the chuck wall, wherein a depth from a lowest interior surface of the annular countersink to an uppermost surface of the curl is between 0.265 to 0.280 inches, wherein the inner countersink wall and the outer countersink wall extend generally parallel, and wherein the first radius of curvature is greater than the second radius of curvature.

2. The can shell of claim 1, wherein the lowest interior surface of the annular countersink has a depth of 0.270 inches from the uppermost surface of the curl.

3. The can shell of claim 1, wherein a depth from a bottom surface of the center panel to a bottom surface of the annular countersink is between 0.085 and 0.11 inches.

4. The can shell of claim 3, wherein a depth from a bottom surface of the center panel to a bottom surface of the annular countersink is 0.100 inches.

5. The can shell of claim 1, wherein the inner countersink wall of the annular countersink has an inner diameter of 1.643 to 1.683 inches.

6. The can shell of claim 1, wherein the inner countersink wall of the annular countersink has an inner diameter of 1.738 to 1.778 inches.

7. The can shell of claim 1, wherein the can end has an outer diameter between 2.20 and 2.28 inches.

8. The can shell of claim 1, wherein the can end has an outer diameter between 2.295 and 2.375 inches.

9. The can shell of claim 1, wherein a ratio of a depth from the uppermost surface of the curl to a lowest interior surface of the annular countersink and an outer diameter of the can end is about 0.115 to about 0.127.

10. The can shell of claim 1, wherein a ratio of a depth from the uppermost surface of the curl to a lowest interior surface of the annular countersink and an outer diameter of the can end is about 0.12 or greater.

11. The can shell of claim 1, wherein a ratio of a depth from the uppermost surface of the curl to a lowest interior surface of the annular countersink and an outer diameter of the can end is about 0.12 based on the depth of about 0.270 inches and the outer diameter of about 2.24 inches.

12. The can shell of claim 1, wherein a ratio of a depth from the uppermost surface of the curl to a lowest interior surface of the annular countersink and an outer diameter of the can end is about 0.115 based on the depth of about 0.270 inches and the outer diameter of about 2.335 inches.

13. The can shell of claim 1, wherein the inclined panel wall extends downward and outward from the center panel at an angle of about 45 degrees.

* * * * *